United States Patent [19]

McMillin et al.

[11] 4,323,601

[45] Apr. 6, 1982

[54] METHOD FOR PRINTING CANS FROM HEAT TRANSFER PAPER

[75] Inventors: Danny L. McMillin, Golden; James S. Stirbis, Littleton, both of Colo.

[73] Assignee: Coors Container Company, Golden, Colo.

[21] Appl. No.: 159,876

[22] Filed: Jun. 16, 1980

Related U.S. Application Data

[63] Continuation of Ser. No. 943,372, Sep. 18, 1978, Pat. No. 4,250,831.

[51] Int. Cl.[3] ..... B05D 5/00

[52] U.S. Cl. ..... 427/287; 8/471; 101/470; 101/DIG. 16; 427/255.5; 427/255.6

[58] Field of Search ..... 101/470, DIG. 16; 118/32, 106, 257, 669; 427/255.6, 255.5, 287; 8/471; 156/201, 464

[56] References Cited

U.S. PATENT DOCUMENTS 1,248,856 12/1917 Henry ..... 118/257 X 3,961,388 6/1976 Jaffa ..... 101/470 X

*Primary Examiner*—Evan K. Lawrence

*Attorney, Agent, or Firm*—Bruce G. Klaas

[57] ABSTRACT

A method and apparatus for continuous heat transfer of ink images onto the outer surfaces of continuously moving generally cylindrical articles from a length of continuously moving heat transfer sheet material having thereon a series of uniformly spaced heat transferable ink images by use of an elongated wrapping and heating tube for continuously wrapping a portion of the sheet material into intimate contact with the outer surface of each cylindrical article as the sheet material and the cylindrical members move through the tube and for heating the wrapped portion of the sheet material and the cylindrical articles during movement through the tube to cause transfer of the ink image to the articles within the tube. The sheet material is thereafter unwrapped and disassociated from the decorated cylindrical members after passing through the tube during continuous movement of the sheet material and the printed cylindrical members.

12 Claims, 5 Drawing Figures

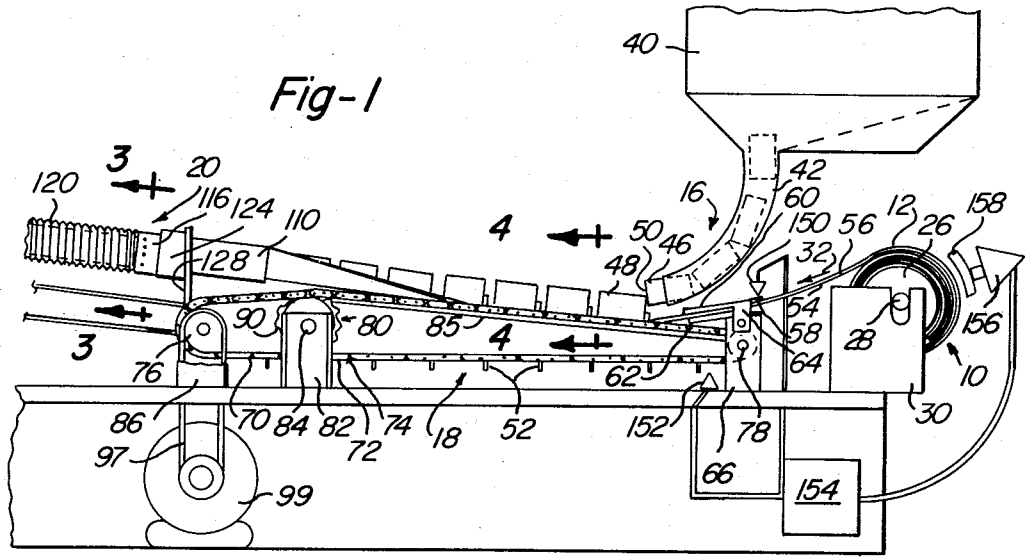
Fig-1
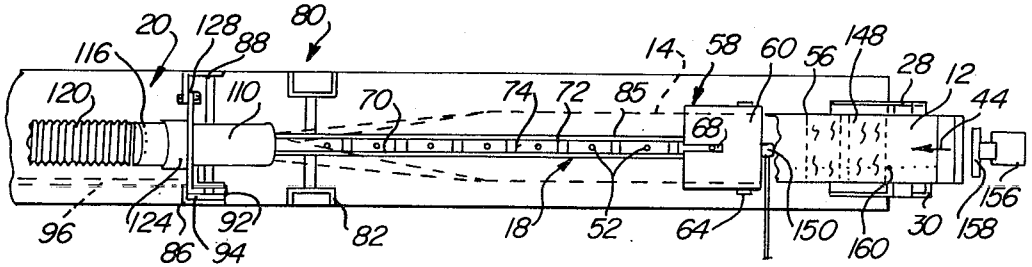
Fig-2
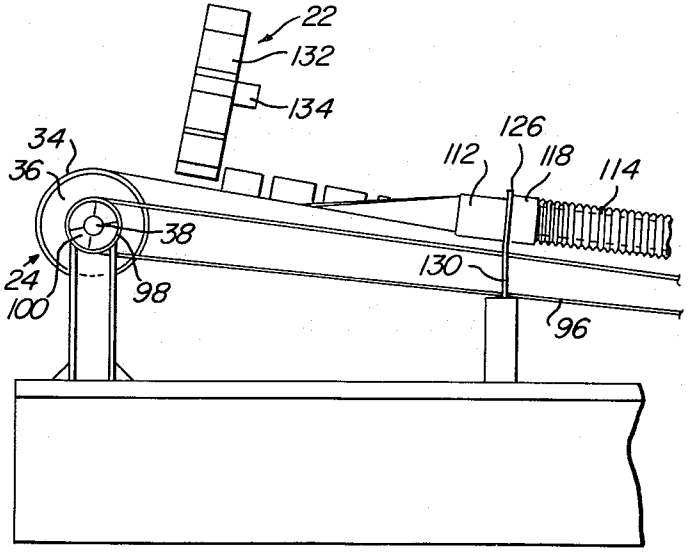
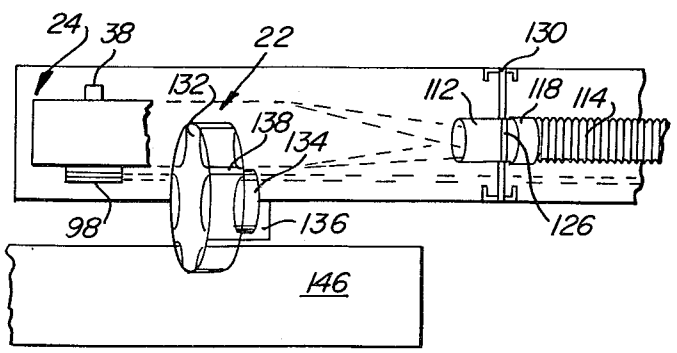

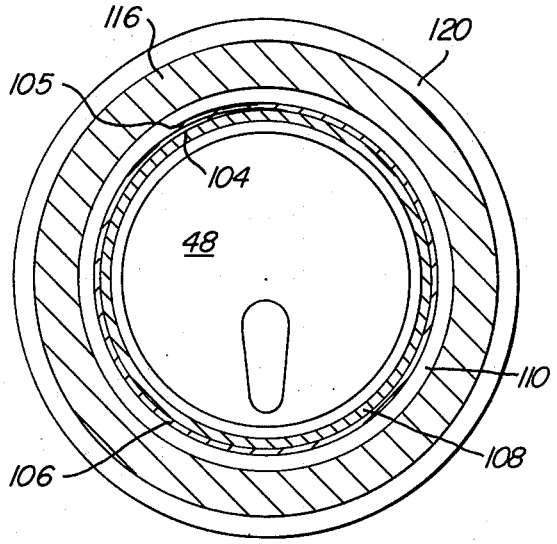
Fig-3
Fig-4
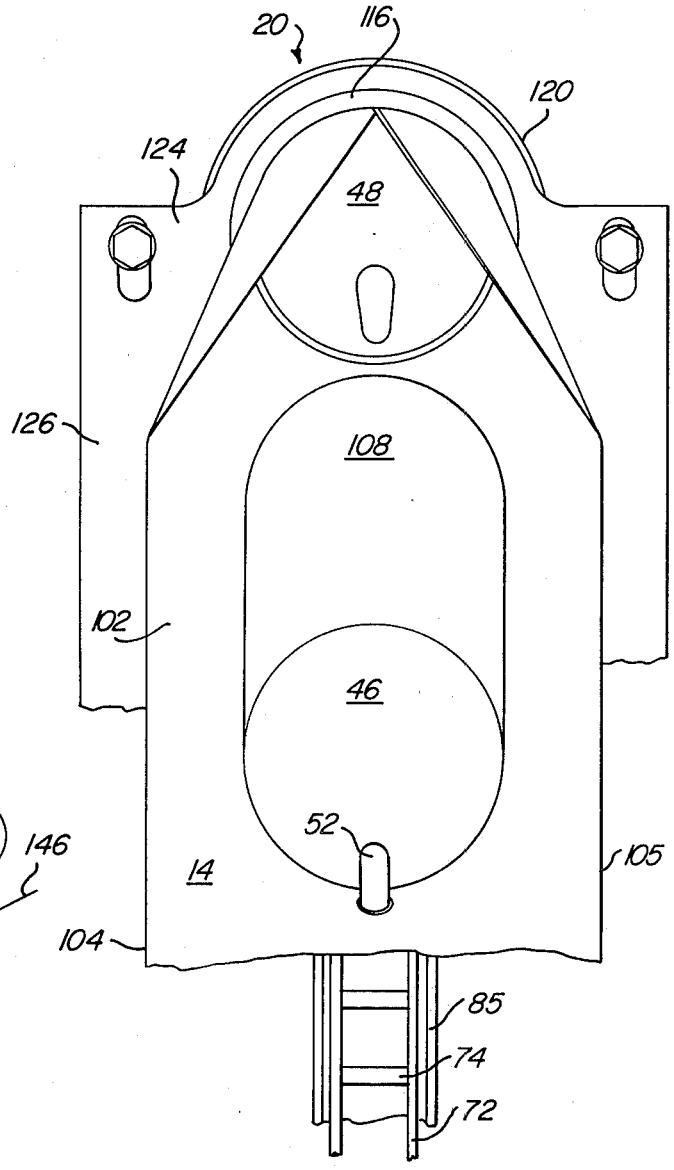
Fig-5
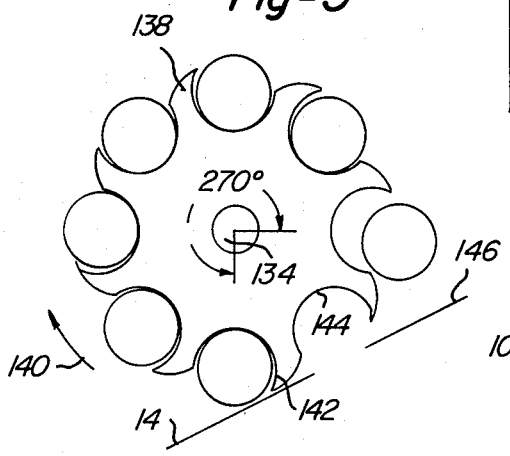

METHOD FOR PRINTING CANS FROM HEAT TRANSFER PAPER

This application is a continuation of prior copending application Ser. No. 943,372, filed Sept. 18, 1978, now U.S. Pat. No. 4,250,831.

BACKGROUND OF THE INVENTION

The present invention relates to methods and apparatus for decorating three dimensional articles such as beverage containers and, more particularly, to heat transfer printing of such containers.

In general, heat transfer printing involves the use of a transfer sheet containing dyes which are sublimatic or meltable. The transfer sheet is made by first printing the dyes in a desired pattern on the transfer sheet, which is usually paper sheet material, in a mirror image of the desired pattern to be applied to the article. Heat transfer printing has previously been utilized primarily for printing on flat articles made of paper, plastic and cloth material. Blake U.S. Pat. No. Re. 27,892 and Sideman U.S. Pat. No. 3,952,131 are illustrative of prior art heat transfer printing methods, inks and materials.

One type of apparatus commonly employed in heat transfer printing is a heated flat press of the type described in Fitzwater U.S. Pat. No. 4,030,962 in which a flat article, such as a garment, is laid on a flat bed, a printed heat transfer sheet is laid on top of the garment, and a flat plate is lowered onto the paper and garment to apply heat and pressure to effect transfer of the pattern from the transfer sheet to the garment. Then the press is opened to remove the garment and the transfer sheet whereupon a new transfer sheet and garment may then be inserted. Thus, the operation is discontinuous, time consuming, laborious and costly.

Another type of prior art heat transfer printing apparatus is shown by Armstrong U.S. Pat. No. 3,848,435, which employs a heated rotating roller with a continuous roll of transfer sheet material and a continuous roll of fabric material being continuously fed to the printing apparatus in face to face relationship. The apparatus comprises a series of rollers, including a heated roller, against which the transfer sheet and the fabric are pressed by a third sheet-like material referred to as an "endless blanket". The endless blanket is made of any heat resistant material and causes the heat transfer paper and the fabric to be pressed against the periphery of the heated roller with the heat transfer paper engaging the heated roller and the fabric engaging the endless blanket. In order to prevent staining of the endless blanket by portions of the heat transfer paper extending beyond the fabric, those portions may be folded over. In another embodiment, the heat source is a semi-circular array of heat lamps disposed above the outer periphery of the printing roll. It is suggested that the printing roll may be air permeable with a vacuum condition being employed to aid in the transfer of dye vapor to the fabric.

Another type of heat transfer printing apparatus is described in Serex et al. U.S. Pat. No. 4,008,998, in which the fabric to be printed, the heat transfer paper and a heating belt are wound into a composite coil, with heat being supplied by the heating belt. In one form, the heating belt has a series of electro-resistant filaments on tapes and, in another form, a single flat and flexible electrical resistance unit covered by insulating material. The heating belt or the fabric is pre-heated, using heated rollers, prior to being wound into the composite coil, which has an axis parallel to the axes of the feeding rollers, and being further heated by the heating belt. In an alternative form, the fabric and heat transfer paper are coiled and heated by hot air in a roller chamber.

Prior to the present invention, it was known to use individual heat transfer sheets to print flat metallic objects and generally cylindrical objects such as pen or pencil casings or beverage containers by rotably contacting the objects with the sheets. Insofar as is known, however, prior heat transfer processes have not been amenable to the high speed decoration of cylindrical containers. Cylindrical containers have heretofore been decorated by placing a container on a rotating mandrel geared to the rotation of a number of rollers. Each roller deposits a different color and pattern on the container. Due to the inherent problems of registry of the patterns and drying of the colors, the art of decorating cylindrical containers has been severely limited. In particular, process or half-tone printing of detailed images on cylindrical objects has not been obtainable with conventional decorating apparatus, insofar as is known.

SUMMARY OF THE INVENTION

A primary object of the present invention is to provide an improved method for continuous mass production decoration of generally cylindrical articles.

In general, the method of the present invention comprises the use of an elongated heating tube means through which a continuous length of heat transfer sheet material is continuously moved in heat transfer printing relationship with spaced continuously moving generally cylindrical members transported through the elongated heating tube means in predetermined relationship to individual heat transfer image sections of the continuous length of heat transfer sheet material. The tube means provides means for wrapping the sheet material, which is preferably paper, intimately about each of the members to be decorated as well as means for providing heat to the sheet material to cause transfer of the ink images thereon to the members to be decorated. The tube means has a generally cylindrical, cross-sectional configuration with an inner diameter closely approximating that of the wrapped cylindrical members.

The tube means may comprise a preheating member, a cooling member, and a heating member in between the two, whereby image transfer takes place only when the sheet material is wrapped in a fixed position relative to the cylindrical member. The pre-heating member, heating member and cooling member comprise circumferentially continuous cylindrical tubes coaxially aligned and joined by thermally insulative wood or plastic collars. Resistance wire is wrapped around the metal heating member to provide heat therein. The transporting means for transporting the generally cylindrical members through the tube means may comprise a moving drive means having a pulley or chain belt from which extends a plurality of pins transverse to the moving sheet of material. The chain belt extends between a drive sprocket and an upstream idler sprocket in the vicinity of a sheet material guide. The sheet material guide may comprise a pair of forwardly angled plates extending laterally across the width of the sheet material. The sheet material guide guides the sheet material along the longitudinal axis of the apparatus and guides the sheet material into driving engagement with the transporting means by providing a resistance against which the pins may press and a slot for receiving the pins. The pins engage a first, or bottom, surface of the sheet material, puncture the sheet material and engage the generally cylindrical members on a second, or top, surface of the sheet material. Movement of the pins on the chain belt thus causes transport of the sheet material and the cylindrical members associated therewith in a predetermined position relative to each other and to the pins.

Sensor means are provided for maintaining the predetermined position between the generally cylindrical members and the sheet material in order to insure proper register of the spaced ink images on the cylindrical members. The sensor means sense the position of the transporting means and of the spaced ink images on the sheet material. The speed of the roller means for unwinding the sheet material is controlled in response to the sensor means. The speed of the sheet material may be adjusted by the use of a friction clutch in the drive of the sheet material takeup means. The clutch is adjusted so that the sheet material tends to advance relative to the transporting means. In this arrangement, the control means for controlling the speed of the sheet material relative to the transporting means may be simply a brake for braking the unwinding roller means. Braking retards the sheet material relative to the transporting means, as the pins rip the sheet material slightly. The cans are thereby advanced in relation to the sheet material.

BRIEF DESCRIPTION OF THE DRAWING

The various features of the exemplary and preferred embodiments of the present invention may best be understood by reference to the accompanying drawing wherein:

FIG. 1 is a side elevational view of the apparatus of the present invention;

FIG. 2 is a plan view of the apparatus of the present invention with parts removed for clarity;

FIG. 3 is a sectional view, taken along line 3—3 of a heating tube of the present invention;

FIG. 4 is a sectional view, taken along line 4—4, of the transporting and tube means of the present invention; and FIG. 5 is an end view of a star wheel of the discharge means of the present invention.

DESCRIPTION OF THE PREFERRED EMBODIMENT

The sheet material used in the present invention may be paper, plastic, cloth, or any other material which can be used as a temporary substrate for heat transfer inks, and which can be wrapped and unwrapped about a three-dimensional object to be printed. Paper is most commonly used as a temporary substrate for heat transfer inks and is presently preferred herein due to its low cost and high material strength. Sublimation inks are preferred to meltable, flowable inks because of the dry, sharp images produced by the former. Each spaced ink image on the sheet material is the mirror image of the final image desired on the three-dimensional object whose outer surface is to be printed. The sheet material may be previously printed with lithographic, flexographic, gravure or other printing techniques adaptable to the particular ink formulations employed. It is contemplated that the previous printing of the sheet material prior to its use in the present apparatus may be accomplished by a printing press operating in conjunction with the present apparatus, whereby sheet material is continuously printed and continuously fed into the apparatus for continuous decoration of three-dimensional objects.

It is also presently preferred that the three-dimensional objects to be printed in the present apparatus be generally cylindrical members such as 12 ounce (350 ml) or 16 ounce (460 ml) metal containers having an approximate 2⅜ inch (5.9 cm) diameter. The containers are formed of metal alloy such as aluminum having an outer surface which has been coated with a thin plastic layer receptive to heat transfer printing. Plastics which can be used for this layer comprise epoxies, polyesters, or a white base polyester coating with a clear epoxy varnish.

Referring now to FIGS. 1 and 2, the apparatus of the present invention may be seen to comprise, in general, roller means 10 for unwinding a roll 12 of sheet material to provide an unwound intermediate length 14 of sheet material; feeder means 16 for feeding the generally cylindrical members to be decorated into association with the sheet material; transporting means 18 for transporting the generally cylindrical members in pre-determined fixed association with the sheet material; tube means 20 for wrapping the sheet material about each of the cans and for providing heat to the sheet material while in intimate contact with the cans to cause decoration of the cans with spaced ink images from the sheet material; discharge means 22 for removing decorated cylindrical members from the sheet material, and takeup means 24 for winding up the sheet material after the decorated cylindrical members have been removed from the sheet material.

The roller means 10 comprises a drum or roller 26 about which a roll 12 of sheet material is longitudinally wound. The roller 26 is suspended at its axial ends by an axle 28 mounted on a stand 30 which permits free rotation of the roller 26. The sheet material unwinds from the top of roller 26, which turns counterclockwise in the view of FIG. 1. The sheet material may alternatively be unwound from the bottom of the roller 26 if the sheet material is wound for such an arrangement. The sheet material moves downstream in the direction of arrow 32 to provide an unwound intermediate length of sheet material 14. The unwound intermediate length of sheet material moves downstream longitudinally past the feeder means 16, through the tube means 20, then to the discharge means 22, and finally to the takeup means 24, where the moving sheet is finally rewound into a roll 34 on a drum 36 which is fixably mounted on a rotatable central shaft 38 which is rotatably driven, as will be described below, to take up the moving sheet into a roll.

The feeder means for feeding the generally cylindrical members into association with the unwound intermediate length of sheet material (FIG. 1) comprises a hopper 40 for holding a continuous supply of members and a chute 42 extending downwardly and forwardly (i.e. downstream) of the hopper. The chute 42 is sized to accommodate a number of cylindrical members which move axially single file, freely through the chute. The chute 42 operates by a gravity feed. The forward opening of the chute is laterally aligned with the central longitudinal axis 44 of the sheet material such that each cylindrical member is deposited in the lateral center of the sheet material. The forward opening of chute 42 is also located just above the sheet material, at a distance less than the diameter of a cylindrical member. An incoming cylindrical member 46 abuts the cylindrical member 48 immediately preceding it, which has been previously placed in association with the sheet material. The forward portion of the chute 42 is at a slight rearward (i.e. upstream) angle to create an angle between the forward surface of the incoming cylindrical member 46 and the rear surface of the preceding cylindrical member 48. This angle creates a tapered space 50 between members as they are feeding into association with the unwound sheet material 14. This space 50 permits a pin of the transporting means to move freely in between members, so that the pin may engage the rear surface of each cylindrical member to transport that member. When decorating members having only one planar end surface, that surface is arranged to be the rear surface for better engagement with the pin.

Alternative feeder means may be used in place of chute 16. A pair of parallel guide rails may be used to support each member along two of its sides and to permit the member to slide longitudinally between the rails. Instead of a hopper and chute arrangement, the cylindrical members may be stacked upwardly on their sides, with their longitudinal axes parallel and aligned with the central longitudinal axis 44 of the moving sheet. As a cylindrical member is associated with the moving sheet, it is carried therealong by a pin and moves out from under the next member to be deposited into association with the moving sheet material. The next member then drops onto the sheet by gravity when the previous member and pin are clear.

In any configuration, the feeder means 16 is located between the roller means 10 and the tube means 20 in a portion of the intermediate unwound sheet material 14 which is slightly concave due to the wrapping action of the tube means. The concave configuration prevents the cylindrical members from rolling off of the moving sheet.

Turning now to the transporting means, the cylindrical members and the sheet material are transported in a predetermined relative position by a drive means comprising a series of pins 52. Each pin is cylindrical and terminates outwardly in a tapered or rounded end. Each pin is brought first into engagement with a first, or bottom, surface 54 of the sheet material, then made to puncture and extend through the second, or upper, surface 56 of the sheet material for a distance sufficient to push and separate the cylindrical members.

The puncturing action of the pins 52 is facilitated by a sheet material guide 58 located in association with the moving sheet between the feeder means 16 and the roller means 10. The sheet material guide 58 comprises an upper plate 60 and a lower plate 62 held together in an acutely angled relationship by a mounting bracket 64. Mounting bracket 64 is affixed to a mounting stand 66. The plates are laterally parallel and laterally extend across and slightly beyond the width of the sheet material. The plates terminate forwardly in straight, parallel, proximate edges forming a transverse slit through which the entire width of the sheet material passes. The plates further comprise central, aligned, longitudinal slots 68 through which the pins 52 pass. The transverse slit serves to hold a portion of the sheet material as a pin moves into the longitudinal slots and punctures the sheet material, as movement of the sheet material away from the pin is resisted by the sides of the slot. After puncturing the sheet material, the pin and sheet move downstream by virtue of the motion of the pins, which extend from a moving, driven chain belt 70. During downstream motion, each pin engages the rear, or upstream, surface of a cylindrical member and thereby causes the cylindrical member to move downstream in association with the sheet material. The spaces between pins are slightly greater (e.g. 1 cm) than the lengths of the cylindrical members in order to insure that the cylindrical members may be freely fed into the spaces between the pins extending through the sheet material. The lengths of the cylindrical members are correlated to the spaces between pins and are preferably uniform.

The chain belt 70 is formed of a number of parallel, oval-like plates 72 connected by pivoting transverse shafts 74. Each pin is secured to a transverse shaft and extends normally therefrom. The chain belt 70 is looped between a downstream, powered drive sprocket 76 and an upstream idler sprocket 78. The idler sprocket 78 turns freely on a shaft mounted in a portion of the mounting stand 66 and is radially proximate to the lower plate 62 of the sheet material guide. The rotation of the idler sprocket 78 thereby causes the pins 52 to move through the longitudinal slots 68 and penetrate the slots to a degree corresponding to the degree of rotation of the idler sprocket. This results in the engaging, penetration and transporting of the sheet material by the pins described above.

A guide sprocket assembly 80 engages the chain belt 70 between the downstream drive sprocket 76 and the upstream idler sprocket 78. The guide sprocket assembly 80 is located just upstream of and adjacent to the tube means 20 and serves to guide the sheet material into the tube means. The guide sprocket assembly 80 comprises a mounting stand 82 bearing a shaft 84 for free rotation of the guide sprocket 90. The guide sprocket 90 orients the upper portion of the chain belt at a slightly forwardly inclined angle guides the sheet material to the entrance of the tube means 20. As the sheet material moves downstream of the guide sprocket 90, the guide sprocket causes the pins 52 to be withdrawn from the sheet material due to the lifting of the sheet material into the tube means and to the downward angle of the chain belt as it approaches the drive sprocket 76. The cylindrical members continue to move into and through the tube means 20 in fixed association with the sheet material after the pins are withdrawn as a result of the wrapping of the sheet material about the cylindrical member caused by the tube means 20.

The sheet material moves in a unwound intermediate length in a uniform, linear path between the sheet material guide 58 and the take-up means 54. The chain belt 70 of the transporting means is convergently angled towards the sheet material to a first upper level at the guide sprocket 90. From the guide sprocket 90, the chain belt forms a divergent angle with the sheet material as the sheet material enters the tube means 20. An elongated, narrow, straight, throughlike member 85 provides lateral and bottom guide surfaces for the upper portion of the chain belt 70 between the sheet material guide 58 and the guide sprocket 90. The troughlike member 85 is mounted on the mounting stand 66 of the idler sprocket 78 and extends downstream therefrom to a cross piece on the mounting stand 82 of the guide sprocket assembly.

The take up means and transporting means of the present apparatus are driven off the drive sprocket 76. The powered drive sprocket 76 is centrally, fixedly mounted to a rotating shaft 88 which is rotatably mounted through a mounting stand 86. A first pulley wheel 92 and a second pulley wheel 94 are concentrically, fixedly mounted on the rotating shaft 88 in spaced axial relationship to the drive sprocket 76 to provide a clearance for pulley belts to the two pulleys. The first pulley wheel 92 is located axially between the drive sprocket 76 and the axially outermost second pulley wheel 94. The first pulley wheel 92 is drivably engaged with a first pulley belt 96 which is looped to drive a takeup pulley wheel 98 mounted on the central shaft 38 of the takeup means 24. The second pulley wheel 94 is drivably engaged with a second pulley belt 97 driven by a motor 99. The motor 99, in turning the rotating shaft 88, drives the drive sprocket 76 and the first pulley wheel 92, which in turn drives the takeup pulley wheel 98. The takeup pulley wheel 98 is mounted on the central shaft 38 through a friction clutch 100. The friction clutch 100, as is known in the art, transmits torque from the pulley wheel 98 to the central shaft 38 in accordance with a preset control which causes the clutch to slip when a certain torque level is reached. Clutch slippage causes the rotation of the pulley 98 to only be partially transmitted to the central shaft 38.

Since rotation of central shaft 38 causes rotation of the takeup drum 36 transporting sheet material to the downstream end of the apparatus, takeup of the sheet material must be approximately coordinated with the transport of the sheet material by the chain belt 70. This coordination is provided by the friction clutch 100. Early in a run, when little sheet material is on the takeup drum, the drum must turn rapidly due to the small rotating diameter. During this time, the torque is relatively low and the friction clutch transmits approximately the full rotational speed of the pulley wheel 98. The amount of sheet material on the takeup drum increases the torque necessary to turn the drum, while the rotational speed of the drum necessary to maintain a constant rate of takeup decreases. At this time, the friction clutch slips and slows the rotation of the takeup drum in proportion to the increased torque necessary to take up the sheet material.

The tube means 20 is located between the sheet material guide 58 and the takeup means 24 in a spaced relationship whereby the unwound intermediate length of sheet material 14 can smoothly, flexibly move from a flat configuration at the sheet material guide 58 to a cylindrical configuration in the tube means 20, and back to a flat configuration at the takeup means 24 as the sheet material moves downstream through its unwound intermediate length. The tube means 20 provides a wrapping of the sheet material into intimate contact with the cylindrical members without the need for any additional forming means. As shown in FIGS. 3 and 4, the sheet material first curls in a concave portion 102 which gradually, uniformly assumes a smaller radius of curvature until the lateral sides 104, 105 of the sheet material are slightly overlapped at the top of the cylindrical bore 106 and the sheet material is in intimate contact with the inner bore surface 106 and with the outer surface 108 of the cylindrical member associated therewith. The sheet material then gradually unwraps as it emerges from the tube means. The distance between the tube means and the sheet material guide and the takeup roll will depend on the nature and width of the sheet material. The width of the sheet material is, in turn, predicated upon the circumference of the cylindrical members, exceeding that circumference by a small amount, one to ten percent. Using paper sheet material 7.25 inches (23 cm) wide and metal cans having a circumference of 7.2 in. (18.5 cm), a distance of 3 feet (0.9 M) 3 feet or more between the tube means and the sheet material guide has been found sufficient to permit smooth wrapping and unwrapping of the paper. Longer distances may be desirable up to the limits of available floor space.

The tube means 20 comprises a preheating member 110, a cooling member 112, and a heating member 114 therebetween. The members are preferably metallic, open-ended, elongated cylinders which are circumferentially continuous to prevent a spreading and expansion of the internal diameter of the members with heat. The internal diameters of the preheating and cooling members are slightly larger (1–10%) than the internal diameter of the heating member in order to accommodate a certain amount of slippage between the sheet material and the cylindrical members 46, 48 in the preheating and cooling members 110, 112. The preheating and cooling members 110, 112 are coaxially connected, to the upstream and the downstream ends, respectively, of the heating member 114. The preheating and cooling members 110, 112 are connected to the heating member 114 by thermally insulative collars 116, 118 at the opposite ends of the heating member. The thermally insulative collars may be of wood, plastic or other material having low thermal conductivity. The inner surfaces of the collars 116, 118 grip the outer surfaces of the preheating, cooling and heating members 110, 112, 114 and hold the members in fixed axial alignment without contact between the members. This prevents heat in the heating member 114 from heating and causing heat transfer in the preheating and cooling members, where slippage might take place. This prevents smudging in the transfer of ink images to the outer surfaces of the cylindrical members, which takes place only in the heating member 114.

The length of the heating member 114 is predicated on the rate of transport of cylindrical members through the heating member, the sublimation or heat transfer rate of the ink images on the sheet material, and the heat and pressure environment in the heating member. It is presently contemplated that the heating member be about of a length which provides approximately six seconds of residence time in the heating member 114.

Resistance wire or rope 120 is wrapped about the outer surface of the heating member in a spiral coil to provide heat transfer contact between the resistance wire 120 and the heating tube member 114. The resistance wire is coiled over a substantial length of the heating tube 114 between the collars 116, 118 to provide uniform heating throughout the length of the tube. The ends of the resistance wire are connected to a variable voltage source 122 as is known for providing a heating current through the wire.

The tube assembly, comprising the pre-heating member, the cooling member, and the connecting collars, is supported by mounting sleeves 124, 126 which extend downwardly to base portions 128, 130. The upstream base portion 128 is mounted on the mounting stand 90 and the upstream base portion is mounted on the stand 86.

The discharge means 22 for removing printed cylindrical members from the sheet material is located between the takeup means 24 and the tube means 20, along a portion of the unwound intermediate length of sheet material 14 wherein the sheet material is in a slightly concave configuration.

Referring now to FIGS. 1, 2 and 5, the discharge means comprises a star wheel 132 as is known in the art of can handling. A star wheel comprises a large rotating disc portion which rotates on a central drive shaft 134 parallel to the central longitudinal axis 44 of the sheet material, but laterally and vertically offset therefrom. The disc portion comprises a number of curved arms 138 extending radially outwardly from the central shaft and curving in the direction of rotation of the disc as shown by arrow 140. Each arm terminates outwardly in a foot portion 142 designed to slide between a cylindrical member and the sheet material. The rotation of the star wheel is keyed to the rate of transport of cylindrical members through the apparatus, so that a foot portion 138 of an arm engages each cylindrical member as it moves towards the rotating disc. The foot portion guides the cylindrical member engaged thereby into a receiving portion 144 of the star wheel which approximates the radius of the cylindrical member which it is designed to transport. Each receiving portion carries a printed cylindrical member from the sheet material, through approximately 270° of rotation, and deposits the cylindrical member onto another piece of equipment 146 for further handling.

During operation of the present apparatus, a control device is necessary to insure proper register between the cylindrical members and the spaced ink images 148 on the sheet material.

The control device comprises a first sensor means 150 for sensing the position of the spaced ink images, a second sensor means 152 for sensing the position of the transporting means, and control means responsive to the two sensor means comprising a comparing circuit 154 and a solenoid actuated brake means 156 having a brake shoe 158 facing the roll 12 of unwinding sheet material. The first sensor means 150 comprises a photoelectric cell mounted on the sheet material guide 58 and looking towards the sheet material. The sheet material is printed with a number of black dots 160 regularly spaced between spaced ink images and which are sensed by the photoelectric cell. The second sensor means 152 comprises a magnetic metal detector mounted in the vicinity of the chain belt 70 so as to sense the position of the pins 52 thereon. The first and second sensor means are input to a control circuit 154 such as an electronic comparator. The circuit is arranged to produce no output for a simultaneous signal from the first and second sensor means. The sensor means are arranged so that a simultaneous signal indicates proper register between the spaced ink images 148 and the cylindrical members abutting the pins so that the ink images neither bleed off the top or off the bottom of the cylindrical members. A non-simultaneous signal causes the control circuitry to activate the solenoid brake 156. The apparatus is adjusted so that any lack of proper registry may be remedied by braking the roller 26 to retard the moving of sheet material. This adjustment is made through the friction clutch 100, which is adjusted to provide a slightly faster take up of sheet material than is provided by the movement of the pins and chain belt. Any lack of register will then be in the images of the sheet material leading the cylindrical members. Activation of the brake is brought about by an amplifier in the control circuit wired to a solenoid which activates a piston-mounted brake shoe 158 which is mounted at the upstream side of the roll 12 of sheet material. The brake piston is spring loaded to be responsive to the amplifier current, which is designed to vary according to the degree of lag in the chain belt.

OPERATION

At the beginning of a run, an operator places a full roll 12 of heat transfer sheet material on the mounting stand 30. The end of the sheet material is threaded through the transverse slit of the sheet material guide 58. The spaced ink images at the end portion of the sheet material are aligned with the transporting means, so that the pins 52 will puncture the sheet material in the appropriate spaces between ink images. The transporting means 18 is started, causing rotation of drive sprocket 78 and the engagement, puncturing and transport of the sheet material. As the leading edge of the sheet material reaches the tube means 20, the transporting means is stopped and a number of cylindrical members are placed on the unwound intermediate length sheet material 14. The operator manually wraps the sheet material about the leading cylindrical member and inserts the wrapped member into the tube means 20. The transporting means is restarted and the operator manually guides the sheet material into the tube means until members and sheet material emerge from the downstream end of the tube means, at which point manual guidance of the sheet material into the tube means is no longer needed. The sheet material is advanced by the transporting means until it reaches the takeup means 24, where the leading edge of the sheet material is affixed to drum 38. The star wheel is manually aligned with a cylindrical member in a receiving portion 144. The voltage source 122 is activated to heat the resistance wire and the heating member 114. The apparatus is now ready for continuous operation and the feeder means, transporting means, control circuit, and discharge means are started.

The cylindrical members pass longitudinally to and through the tube means in association with the sheet material, which is unwound from a roller means, and fed into the tube means in a generally cylindrical configuration contacting and conforming to the inner surface of the tube means and the outer surfaces of the generally cylindrical members. From the tube means, the sheet material is unwrapped and fed to a driven takeup means for rewinding the sheet material. Due to the flexible, resilient nature of the sheet material, the sheet material gradually passes from a flat configuration to a partially wrapped, or curled, configuration, to a wrapped configuration, to a partially unwrapped configuration, and back to a flat configuration. This takes place without any shaping mechanism other than the tube means.

Thus, there has been provided an apparatus for continuous decoration of three-dimensional, generally cylindrical objects from a flat roll of heat transfer sheet material. The flexible nature of the sheet material provides smooth transition from a flat configuration to a cylindrical wrapped configuration and back to a flat configuration giving the present apparatus a high speed capability. The pins of the drive means provide continuous transport of cylindrical members in a predetermined position relative to the sheet material. Due to the continuous cylindrical member feeding and discharge, and due to the feedback control of the sensing means, the apparatus may run with a minimum of operator control.

While the foregoing invention has been described with reference to an illustrative and presently preferred embodiment thereof, the invention may be variously modified and otherwise constructed. It is therefore intended that the following claims be construed to include alternative embodiments except insofar as limited by the prior art.

What is claimed is:

1. A method of continuous transfer of images onto outer surfaces of generally cylindrical members by use of a sheet material having a series of spaced heat transferable ink images thereon comprising the steps of:

continuously unwinding a roll of sheet material and rewinding sheet material at a distance from said unwinding to provide a moving unwound intermediate length of material;

feeding in spaced sequence the generally cylindrical members into association with said unwound intermediate length of material;

transporting said generally cylindrical members in a predetermined position relative to said spaced ink images on the moving intermediate length of material;

wrapping the unwound intermediate length of material about the outer surfaces of the generally cylindrical members associated therewith to form wrapped cylindrical members;

heating said wrapped cylindrical members to cause the transfer of said images to the outer surfaces of the generally cylindrical members;

unwrapping the unwound intermediate length of material from said wrapped cylindrical members after said heating; and removing cylindrical members from said intermediate length of material.

2. The method of claim 1 wherein said transporting comprises the step of:

penetrating said unwound intermediate length of material with moving pins; and thereafter engaging each of said generally cylindrical members with one of said pins and thereby transporting said member in a predetermined position relative to said spaced ink images on said moving intermediate length of material.

3. The method of claim 2 wherein said feeding in spaced sequence comprises the step of:

feeding said members at an angle between a member associated with said unwound intermediate length and a member next in said sequence, wherein said angle provides space for one of said pins.

4. The method of claim 2 further comprising the step of:

driving a chain belt bearing said pins.

5. The method of claim 4 further comprising the step of:

rewinding said sheet material with power provided for driving said chain belt.

6. The method of claim 5 further comprising the step of:

adjusting said rewinding to provide a speed of said moving unwound intermediate length slightly greater than said transport speed.

7. The method of claims 1 or 6 further comprising the steps of:

sensing the position of said spaced ink images; while sensing the position of said transporting means; and controlling movement of said moving intermediate length of material in response to said sensing steps, thereby bringing the spaced ink images into register with the cylindrical members which are in a predetermined position relative to said spaced ink images.

8. The method of claim 7 wherein said controlling step consists of retarding said unwinding.

9. The method of claims 1 or 2 wherein said wrapping, said heating, and said unwrapping steps are comprised in the step of:

passing said unwound intermediate length of sheet material and said generally cylindrical members associated therewith through a tube assembly to initially contact said sheet material and said generally cylindrical members, which comprises a preheating member, a heating member and a cooling member and then causing said sheet material to exit said tube assembly and be unwrapped and separated from said cylindrical members.

10. The method of claim 9 wherein said heating step comprises the step of:

passing an electric current through resistance wire associated with said heating member of said tube assembly.

11. The method of claim 1 further comprising the step of:

passing said moving intermediate length of material through a guide for flattening said material and for positioning said material for said transporting of said generally cylindrical members.

12. A method of continuous transfer of images on outer surfaces of generally cylindrical members by use of a sheet material having a series of spaced heat transferable ink images thereon comprising:

continuously unwinding a roll of sheet material having a width sufficient to surround an outer surface of one of said generally cylindrical members;

providing a portion of moving unwound sheet material;

wrapping said unwound sheet material about each of said generally cylindrical members, in intimate contact with the outer surface of each cylindrical member, with each cylindrical member in a predetermined position relative to a spaced ink image, and thereby providing a first concave portion of moving sheet material upstream of the region of said wrapping in intimate contact;

feeding the generally cylindrical members into association with the first concave portion of said moving sheet material;

heating said sheet material while the sheet material is wrapped about each generally cylindrical member to cause the transfer of said images to the outer surfaces of the generally cylindrical members;

after heating, unwrapping said sheet material to provide a second concave portion of moving sheet material;

removing said generally cylindrical members from said second concave portion of moving sheet material; and rewinding said moving sheet material.

* * * * *